US008166982B2

(12) United States Patent
Hsu

(10) Patent No.: US 8,166,982 B2
(45) Date of Patent: May 1, 2012

(54) BARRETTE CHANGEABLE TO HAIR CLIP

(76) Inventor: Shih Ling Hsu, Tainan (TW)

( * ) Notice: Subject to any disclaimer, the term of this patent is extended or adjusted under 35 U.S.C. 154(b) by 287 days.

(21) Appl. No.: 12/462,532

(22) Filed: Aug. 5, 2009

(65) Prior Publication Data

US 2011/0030720 A1 Feb. 10, 2011

(51) Int. Cl.
*A45D 8/00* (2006.01)
*A45D 40/26* (2006.01)
*A44B 17/00* (2006.01)

(52) U.S. Cl. ..... 132/273; 132/278; 132/133; 24/495

(58) Field of Classification Search ..... 132/126, 132/129, 132, 133, 273, 275, 276, 277, 278, 132/279; D28/39, 41; 24/336, 489, 495
See application file for complete search history.

(56) References Cited

U.S. PATENT DOCUMENTS

| | | | | |
|---|---|---|---|---|
| 5,546,966 | A | 8/1996 | Lin | 132/279 |
| 5,597,000 | A | 1/1997 | Gerber | 132/279 |
| 5,694,956 | A | 12/1997 | Grinszpan | 132/275 |
| 5,865,190 | A | 2/1999 | Butler | 132/208 |
| 5,896,862 | A | 4/1999 | Hwang | 132/145 |
| 5,915,532 | A | 6/1999 | Williams | 2/171 |
| 6,024,102 | A | 2/2000 | Huang | 132/273 |
| 2006/0076033 | A1* | 4/2006 | Bouix | 132/320 |
| 2010/0018544 | A1* | 1/2010 | Hsu | 132/279 |

* cited by examiner

*Primary Examiner* — Todd Manahan
*Assistant Examiner* — Niyati D Shah
(74) *Attorney, Agent, or Firm* — Charles E. Baxley

(57) ABSTRACT

A hair barrette includes two barrette members each having an outer head engaging end and an ear extended from an inner coupling end, and a coupling device includes two coupling members disposed above and below the ears and having two pivot axles for pivotally coupling the ears between the coupling members and for allowing the barrette members to be folded to an opened working position where the barrette members are opened and oppositely spaced from each other for forming or operating as a hair barrette device, and to be folded relative to each other to a folded storing position where the barrette members are engaged with each other for forming or operating as a hair clip device.

6 Claims, 7 Drawing Sheets

BARRETTE CHANGEABLE TO HAIR CLIP

BACKGROUND OF THE INVENTION

1. Field of the Invention

The present invention relates to a hair barrette, and more particularly to a hair barrette including a foldable structure changeable to a hair clip, or convertible or changeable between a hair barrette or headband and a hair clip for allowing the hair barrette to suitably style the hair of the user.

2. Description of the Prior Art

Typical hair clips comprise two elongated clip members or comb members biased together with a spring biasing member for clasping or clipping the hair of the user.

For example, U.S. Pat. No. 5,546,966 to Lin, U.S. Pat. No. 5,597,000 to Gerber, U.S. Pat. No. 5,694,956 to Grinszpan, U.S. Pat. No. 5,865,190 to Butler, and U.S. Pat. No. 5,896,862 to Hwang disclose five of the typical hair clips each also comprising two elongated clip members or comb members pivotally or rotatably coupled together, and a spring biasing member engaged between the clip members or comb members for biasing the clip members or comb members together and for clasping or clipping the hair of the user.

However, the typical hair clips may not be changed to a hair barrette or headband and thus may not be suitably operated by the user.

U.S. Pat. No. 5,915,532 to Williams, and U.S. Pat. No. 6,024,102 to Huang disclose two of the typical hair barrettes each comprising one or more arched or curved headband member for engaging onto the head of the user.

However, the typical hair barrettes may not be changed to a hair clip and thus may not be suitably operated by the user.

The present invention has arisen to mitigate and/or obviate the afore-described disadvantages of the conventional hair barrettes and the hair clips.

SUMMARY OF THE INVENTION

The primary objective of the present invention is to provide a hair barrette including a foldable structure convertible or changeable to a hair clip, or changeable between a hair barrette or headband and a hair clip for allowing the hair barrette to suitably style the hair of the user.

In accordance with one aspect of the invention, there is provided a hair barrette comprising two barrette members each including an outer head engaging end for engaging with a head of a user, and each including an inner coupling end for pivotally coupling together, and each including an ear extended from the inner coupling end thereof, and a coupling device including two coupling members disposed above and below the ears respectively, and including two pivot axles for pivotally coupling the ears of the barrette members between the coupling members and for allowing the barrette members to be folded to an opened working position where the barrette members are opened and oppositely spaced from each other and in line with each other for forming a hair barrette device, and to be folded relative to each other to a folded storing position where the barrette members are engaged with each other for forming a hair clip device.

The coupling members each include two depressions formed therein for pivotally receiving and engaging with the ears of the barrette members respectively and for pivotally coupling the ears of the barrette members together.

The barrette members each include an orifice formed in the ear, and the coupling members each include two hub members extended into the depressions thereof respectively for engaging with the orifices of the ears and for pivotally coupling the ears together and for forming the pivot axles.

The barrette members each include at least one first engaging member formed in the ear, and the coupling members each include at least one second engaging member for engaging with the first engaging member and for anchoring the barrette members to the coupling members at a predetermined angular position.

The first engaging member may be selected from an orifice formed in the ear. The second engaging member may be selected from a projection extended from the coupling members. The barrette members each include a number of comb teeth extended therefrom for styling the hair of the user.

The barrette members each include a stop extended from the inner coupling end thereof for engaging with the coupling members and for anchoring the barrette members to the coupling members at the opened working position.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
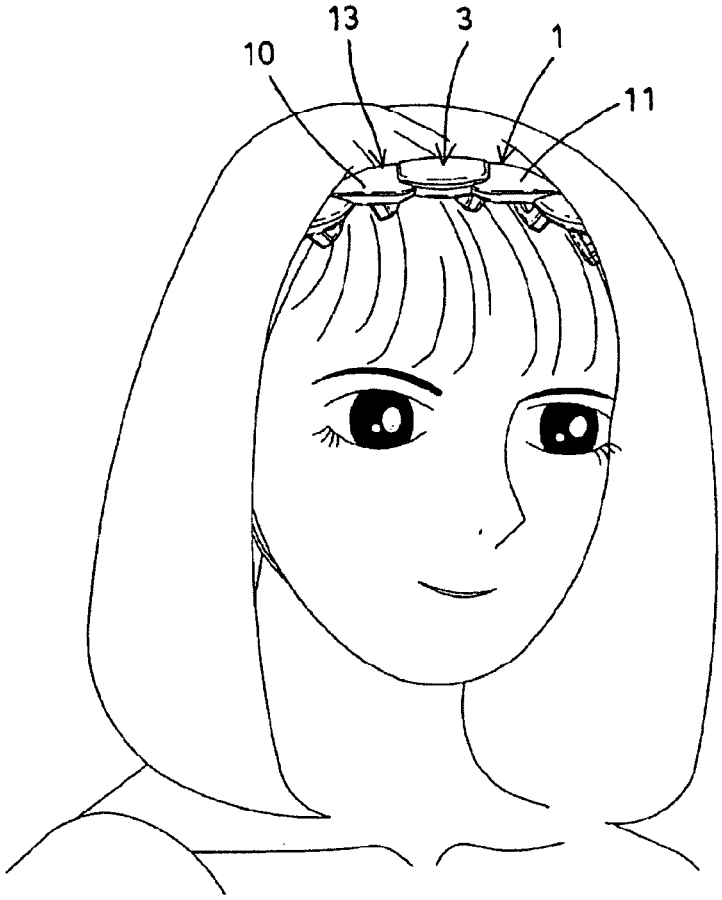
FIG. 1 is a perspective view of a hair barrette in accordance with the present invention, illustrating the operation or the attachment of the hair barrette onto a head of the user.

Referring to the drawings, and initially to FIGS. 1-4, a hair barrette 1 in accordance with the present invention comprises two elongated and/or arched or curved barrette members 10, 11 each including an outer end or curved head engaging end 12 for suitably and comfortably engaging with the head of the user and for styling the hair of the user, and each including an inner end or coupling end 13 for pivotally or rotatably coupling together, and each including a number of comb teeth 14 for styling the hair of the user, and each including an ear 15 extended from the inner end or coupling end 13 thereof, and each including an orifice 16 formed in the ear 15 for pivotally or rotatably coupling purposes.

The barrette members 10, 11 each further include an anchor or stop 17 extended from the inner end or coupling end 13 thereof and spaced from the ear 15 or extended beside the ear 15, and each include one or more (such as three) projections or notches or engaging members 18 formed on the outer peripheral portion of the ear 15 and spaced ninety (90) degrees apart from each other, the ears 15 of the barrette members 10, 11 are provided for pivotally or rotatably coupling the barrette members 10, 11 together with a pivotal coupling device 3 which will be described in details hereinafter.

Figure 2:
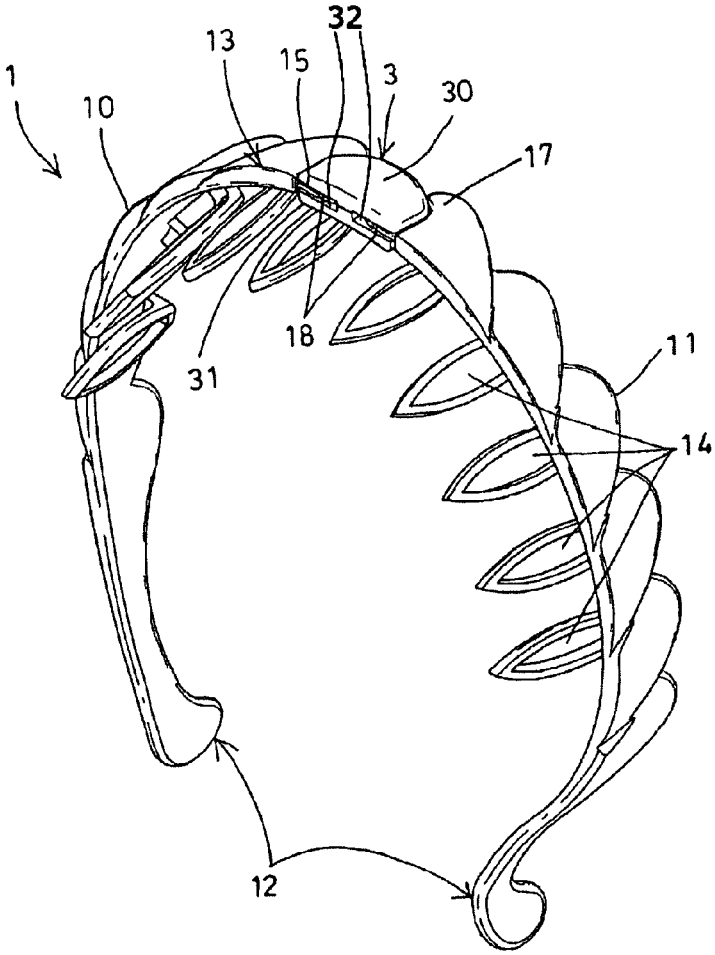
FIG. 2 is a perspective view of the hair barrette.
Figure 3:
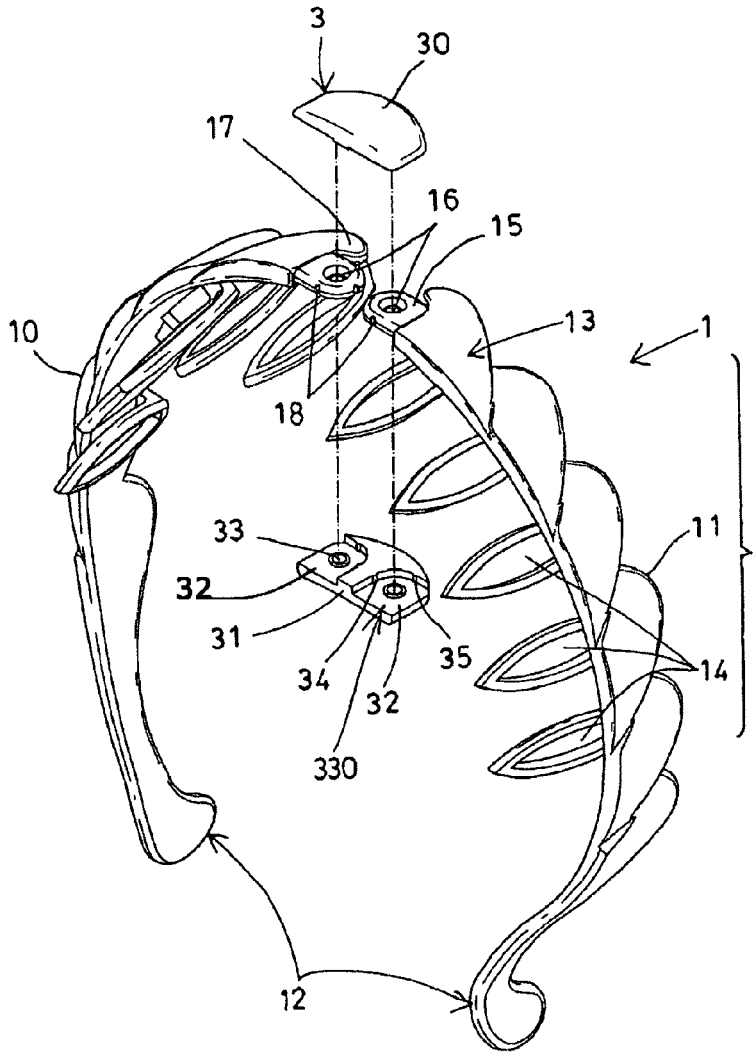
FIG. 3 is a partial exploded view of the hair barrette.
Figure 4:
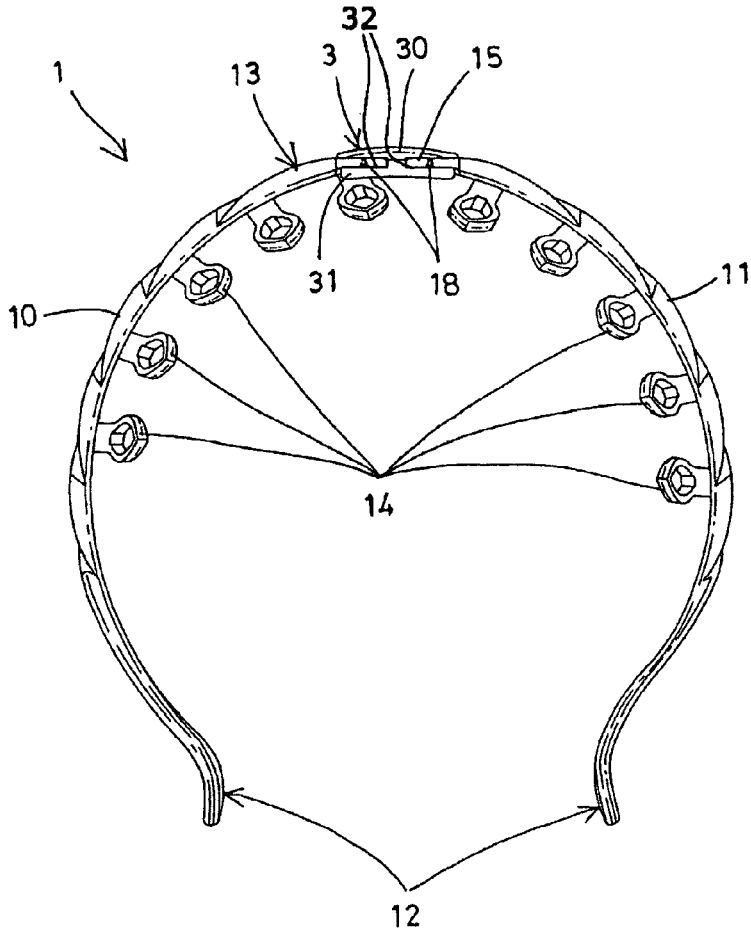
FIG. 4 is a front plan schematic view of the hair barrette.

As shown in FIGS. 2-4, and particularly to FIG. 3, the pivotal coupling device 3 includes two coupling members 30, 31 attached onto the upper portion and the lower portion of the ears 15 or disposed above and below the ears 15 respectively, and each having two depressions 32 formed therein for pivotally or rotatably receiving or engaging with the ears 15 of the barrette members 10, 11 respectively, and each having two protrusions or hub members 33 extended into the depressions 32 thereof respectively for engaging with or into the orifices 16 of the ears 15 respectively and for pivotally or rotatably coupling the ears 15 of the barrette members 10, 11 together. The hub members 33 and/or the coupling members 30, 31 may further be solidly secured and coupled together with latches or fasteners (not shown), adhesive materials or by welding processes and arranged for allowing the barrette members 10, 11 to be pivoted or rotated relative to the coupling members 30, 31 with the hub members 33 that may be acted or formed or operated as two pivot axles 330 for pivotally coupling the ears of the barrette members between the coupling members.

The coupling members 30, 31 each may further include one or more (such as two) notches or projections or engaging members 34, 35 formed or extended therein or extended into the depressions 32 of the coupling members 30, 31 respectively for engaging the notches 18 of the ears 15 respectively and for anchoring or positioning the barrette members 10, 11 to the coupling members 30, 31 of the pivotal coupling device 3 at the required or predetermined angular positions, for example, the barrette members 10, 11 may be anchored or positioned to the coupling members 30, 31 of the pivotal coupling device 3 at the opened working position where the barrette members 10, 11 are opened and oppositely spaced from each other or in line with each other for acting and forming as a hair barrette device, best shown in FIGS. 1-2 and 4. At this moment, the anchors 17 of the barrette members 10, 11 may be engaged with each other or may be engaged with the coupling members 30, 31 for anchoring or positioning the barrette members 10, 11 to the coupling members 30, 31 of the pivotal coupling device 3 at the opened working position.

Figure 5:
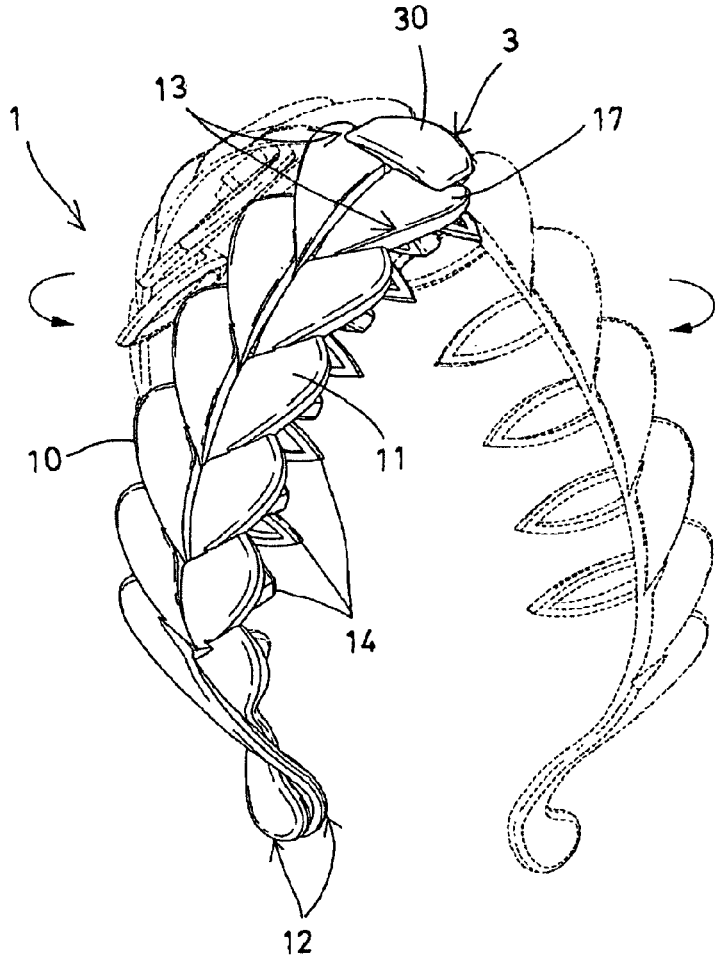
FIG. 5 is a perspective view of the hair barrette foldable and changeable to a hair clip.
Figure 6:
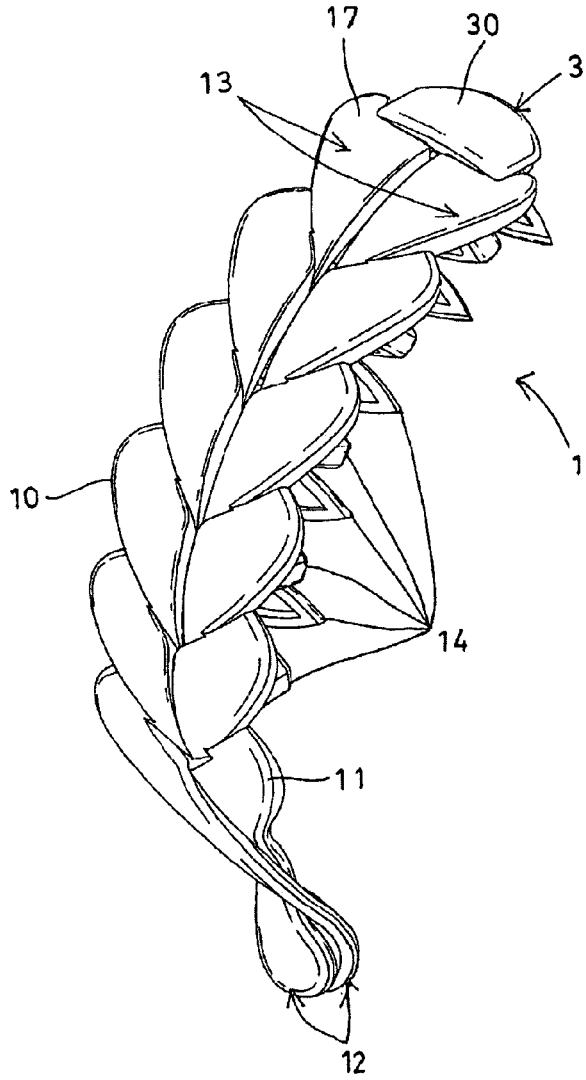
FIG. 6 is a perspective view illustrating the operation of the hair barrette as a hair clip.
Figure 7:
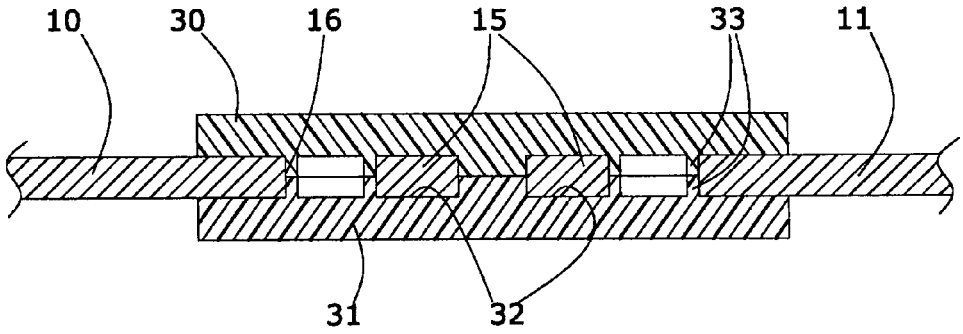
FIG. 7 is an enlarged partial cross sectional view of the hair barrette.

The barrette members 10, 11 may also be anchored or positioned to the coupling members 30, 31 of the pivotal coupling device 3 at the partially folded position where the barrette members 10, 11 are spaced ninety (90) degrees apart from each other, and the barrette members 10, 11 may further be folded relative to each other at the completely folded or storing position where the barrette members 10, 11 are superposed or engaged with each other for acting and forming as a hair clip device, best shown in FIGS. 5-6. The outer ends or curved head engaging ends 12 of the barrette members 10, 11 may be engaged with each other for clasping or clipping the barrette members 10, 11 onto the head and the hair of the user.

Accordingly, the hair barrette in accordance with the present invention includes a foldable structure changeable to a hair clip, or convertible or changeable between a hair barrette or headband and a hair clip for allowing the hair barrette to suitably style the hair of the user.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A hair barrette comprising:

two barrette members each including an outer head engaging end for engaging with a head of a user, and each including an inner coupling end for pivotally coupling together, and each including an ear extended from said inner coupling end thereof, and a coupling device including two coupling members disposed above and below said ears respectively, and including two pivot axles for pivotally coupling said ears of said barrette members between said coupling members and for allowing said barrette members to be folded to an opened working position where said barrette members are opened and oppositely spaced from each other and in line with each other for forming a hair barrette device, and to be folded relative to each other to a folded storing position where said barrette members are engaged with each other for forming a hair clip device, said coupling members each including two depressions formed therein for pivotally receiving and engaging with said ears of said barrette members respectively and for pivotally coupling said ears of said barrette members together, and said barrette members each including an orifice formed in said ear, and said coupling members each including two hub members extended into said depressions thereof respectively for engaging with said orifices of said ears and for pivotally coupling said ears together and for forming said pivot axles.

2. The hair barrette as claimed in claim 1, wherein said barrette members each include at least one first engaging member formed in said ear, and said coupling members each include at least one second engaging member for engaging with said first engaging member and for anchoring said barrette members to said coupling members at a predetermined angular position.

3. The hair barrette as claimed in claim 2, wherein said at least one first engaging member is an orifice formed in said ear.

4. The hair barrette as claimed in claim 2, wherein said at least one second engaging member is a projection.

5. The hair barrette as claimed in claim 1, wherein said barrette members each include a stop extended from said inner coupling end thereof for engaging with said coupling members and for anchoring said barrette members to said coupling members at the opened working position.

6. The hair barrette as claimed in claim 1, wherein said barrette members each include a plurality of comb teeth extended therefrom.

* * * * *